US006998525B2

(12) United States Patent
Erismann

(10) Patent No.: US 6,998,525 B2
(45) Date of Patent: Feb. 14, 2006

(54) STRING TENSIONING DEVICE FOR A STRING INSTRUMENT

(76) Inventor: Mark Erismann, Delfterstrasse 41, CH-5004 Aarau (CH)

( * ) Notice: Subject to any disclaimer, the term of this patent is extended or adjusted under 35 U.S.C. 154(b) by 75 days.

(21) Appl. No.: 10/716,666

(22) Filed: Nov. 20, 2003

(65) Prior Publication Data

US 2004/0159205 A1 Aug. 19, 2004

(30) Foreign Application Priority Data

Feb. 12, 2003 (CH) ..... 0210/03

(51) Int. Cl.
*G10D 3/00* (2006.01)

(52) U.S. Cl. ..... 84/297 R; 84/312 R; 473/534

(58) Field of Classification Search ..... 84/312 R, 84/297 R, 298, 299; 473/534
See application file for complete search history.

(56) References Cited

U.S. PATENT DOCUMENTS

| | | | |
|---|---|---|---|
| 2,813,448 | A | 11/1957 | Robinson |
| 3,830,132 | A | 8/1974 | Lowe |
| 4,497,236 | A | 2/1985 | Rose |
| 4,674,387 | A | 6/1987 | Caruth |
| 4,724,737 | A | 2/1988 | Fender |
| 6,624,347 | B2 | 9/2003 | Erismann |

FOREIGN PATENT DOCUMENTS

| | | |
|---|---|---|
| DE | 10132643 | 2/2002 |
| WO | 00/25296 | 5/2000 |

*Primary Examiner*—David Martin
*Assistant Examiner*—Jianchun Qin
(74) *Attorney, Agent, or Firm*—Greenblum & Bernstein, P.L.C.

(57) ABSTRACT

String tensioning system for a stringed instrument having an instrument body, at least one tensionable string that is fixed at both its ends to the instrument body, and a chamber accommodating a portion of the at least one tensionable string when the portion is arranged between a string introduction aperture and a fixing point arranged opposite to the string introduction aperture, wherein the system includes at least one string tensioning device that can be activated from outside of the instrument body. The at least one string tensioning device is accommodated in a chamber of the instrument body. The at least one string tensioning device includes a tensioning screw and a string tensioning head. The tensioning screw extends into the chamber. The string tensioning head is connected to the portion and is movable in a longitudinal direction by rotating the tensioning screw. A free space is arranged on opposite sides of the string tension head. Each free space allows for a free movement of the portion between the string tensioning head and the feed aperture and between the string tensioning head and the fixing point. This Abstract is not intended to define the invention disclosed in the specification, nor intended to limit the scope of the invention in any way.

29 Claims, 5 Drawing Sheets

STRING TENSIONING DEVICE FOR A STRING INSTRUMENT

CROSS-REFERENCE TO RELATED APPLICATIONS

The present application claims priority under 35 U.S.C. §119 of Swiss Patent Application No. 2003 0210/03, filed on Feb. 12, 2003, the disclosure of which is expressly incorporated by reference herein in its entirety.

BACKGROUND OF THE INVENTION

1. Field of the Invention

The present invention relates to a string tensioning device for a stringed instrument with an instrument body with at least one tensionable string on the surface of the instrument body. The string(s) is/are fixed at both its ends to the instrument body. A string tensioning device can be activated from the outside. The string tensioning device is accommodated in a chamber that is present or arranged in the instrument body between a string introduction aperture that opens into the chamber and a fixing point. The fixing point lies opposite to the aperture in the chamber. The device comprises a tensioning screw aligned from the outside and arranged crosswise to the connecting line between the string feed aperture and the fixing point of the string. The tensioning screw interacts with a string tensioning head that is connected to the string and that can be displaced or moved in the longitudinal direction by rotating the tensioning screw.

2. Discussion of Background Information

A string tensioning device of the type mentioned at the outset is known from German Preliminary Published Application DE-A1-10132643. In this Preliminary Published Application, a string tensioning device is disclosed that is accommodated in a chamber present in the instrument body. The string tensioning device lies in the chamber between a string introduction aperture opening into the chamber and a fixing point of the one end of the string lying opposite to the aperture in the chamber. The other end of the string is fixed to the instrument body in the other far end area of the instrument. This string tensioning device contains a tensioning screw aligned crosswise to the connecting line between the string introduction aperture and the fixing point of the one end of the string which screw has a string tensioning head that is embodied as a screw nut and that can be displaced on it by rotating the tensioning screw. During the tensioning, the string connected to the string tensioning head is drawn into a sleeve surrounding the string tensioning head and is tensioned thereby. The string is drawn thereby around the sharp edge of the sleeve that guides and surrounds the string tensioning head, as a result of which an undesired wear of the string and a concomitant danger of a string breakage occurs. Moreover the frictional resistance of the string around the sharp edge of the sleeve is relatively high, so that a relatively high expenditure of force is required to tension the string.

SUMMARY OF THE INVENTION

The present invention provides for a string tensioning device of the type mentioned at the outset that allows the danger of a string breakage to be avoided. The device can be activated with a relatively low expenditure of force, and features economic advantages.

The invention also provides that, near the string tensioning head connected to the string, a free space is provided on both sides of the connecting point. The free space permits a free lateral movement of the longitudinally displaceable string in the movement area of the string tensioning head between the string tensioning head and the feed aperture, as well as between the string tensioning head and the fixing point. Through this measure the string is guided between the feed aperture and the string tensioning head and also between the fixing point of the end of the string and the string tensioning head, without a sharp-edged change in direction. By this arrangement, the danger of an excessive string wear and a possible string breakage can be avoided. The expenditure of force during the string tensioning is also relatively low. This is because the string does not have to be drawn around sharp-edged places.

The string tensioning head is advantageously guided in a block-shaped guiding body. The guiding body features a slot-shaped recess on both sides of the movement area of the string tensioning head. This recess permits a free lateral movement of the string, on the one hand between the string tensioning head and the feed aperture, and on the other hand between the string tensioning head and the fixing point. The block-shaped guiding body is simple to manufacture and is also suitable for guiding the string tensioning head. The slot-shaped recesses installed in the guiding body, facing towards the feed aperture and the fixing point, allow a free lateral movement of the longitudinally displaceable string around the guided string tensioning head.

The string tensioning head can be guided in a sleeve slotted on both sides at least in the movement area of the string tensioning head. The sleeve is fixed with both its ends in the instrument body. The sleeve, which is made of metal as a rule, ensures a good torsion-proof guiding for the string tensioning head. This sleeve can be provided with two longitudinal slots opposite to one another, by simple arrangement. The longitudinal slots on the one hand allow the bilateral free movement of the string connected to the string tensioning head and on the other hand allow a torsion-proof guiding of the string tensioning head, which is equipped with a laterally projecting pin guided in a longitudinal slot.

The block-shaped guiding body can comprise the end part of the instrument body provided with slots, whereby the slots at their corner areas facing away from the instrument body are filled with pieces of material inset and fixed therein. This leaves free the free spaces provided for the string. The utilization of the instrument body itself for the formation of the string tensioning device enables a particularly cost-effective embodiment and manufacture of the entire string tensioning device.

The string tensioning head provided with an internal screw thread and guided in a torsion-proof manner on a tensioning screw can feature a side wing lying near the tensioning screw. The side wing is connected to the string. A free space is perpendicular to the displacing direction of the string tensioning head. The free space faces towards the feed aperture and the fixing point and is present on both sides of the connecting point. With this arrangement, the string tensioning head is embodied as a traveling nut, by way of which a string tensioning device is formed that is cost-effectively advantageous and simple to install.

The invention also provides for a string tensioning system for a string instrument having an instrument body, at least one tensionable string that is fixed at both its ends to the instrument body, and a chamber accommodating a portion of the at least one tensionable string when the portion is arranged between a string introduction aperture and a fixing point arranged opposite to the string introduction aperture, wherein the system comprises at least one string tensioning device that can be activated from outside of the instrument body, wherein the at least one string tensioning device is accommodated in a chamber of the instrument body. The at least one string tensioning device comprises a tensioning screw and a string tensioning head. The tensioning screw extends into the chamber. The string tensioning head is connected to the portion and is movable in a longitudinal direction by rotating the tensioning screw. A free space is arranged on opposite sides of the string tension head. Each free space allows for a free movement of the portion between the string tensioning head and the feed aperture and between the string tensioning head and the fixing point.

The tensioning screw may extend into the chamber crosswise to an axis running through the string introduction aperture and the fixing point. The system may further comprise a guiding body, wherein the string tensioning head is guided in the guiding body. The guiding body may be a block-shaped guiding body. The guiding body may comprise oppositely arranged slot-shaped recesses, wherein the slot-shaped recesses accommodate movement of the portion and allow for a free lateral movement of the at least one tensionable string between the string tensioning head and the feed aperture and between the string tensioning head and the fixing point.

The system may further comprise at least one guiding sleeve, wherein the string tensioning head is guided within the at least one guiding sleeve. The at least one guiding sleeve may comprise oppositely arranged slots which accommodate the portion. The at least one guiding sleeve may comprise ends which are one of fixed to the instrument body and non-movably mounted to the instrument body. The system may further comprise at least one slot formed on an end of the instrument body, wherein the at least one slot communicates with the chamber. The system may further comprise pieces of material arranged in corner areas of the chamber. The pieces of material may be inset and fixed, whereby free spaces are provided between adjacent pieces of material.

The system may further comprise at least one tuning screw coupled to the tensioning screw. The system may further comprise at least one tuning screw threadably engaging the tensioning screw, wherein rotation of the tuning screw causes the tensioning screw and the string tensioning head to move towards or away from the tuning screw. The system may further comprise at least one tuning screw connected to the tensioning screw, wherein rotation of the tuning screw causes the string tensioning head to move towards or away from the tuning screw. The tensioning screw may be axially retained and rotatable.

The system may further comprising a mechanism for preventing rotation of the string tensioning head. The mechanism may be connected to the string tensioning head. The mechanism may comprise one of a projection and a pin. The system may further comprise at least one guiding slot which receives the mechanism and which guides the string tensioning head in the longitudinal direction.

The string tensioning head may comprise an internal screw thread and an extended side portion that is connected to the portion. The extended side portion may comprise an opening that receives the portion. The string tensioning head may comprise a surface which engages another surface to prevent rotation of the string tensioning head during longitudinal movement of the string tensioning head. The instrument body may be a guitar body.

The invention also provides for a string tensioning system for a string instrument having an instrument body, a plurality of strings, and a chamber accommodating end areas of the strings when the end areas are arranged between string introduction apertures and string exit apertures, wherein the system comprises a plurality of string tensioning devices adapted to be mounted to the stringed instrument. Each string tensioning device comprises a rotatable tuning mechanism, a tensioning screw, and a string tensioning head. Each tensioning screw is adapted to extend into the chamber. Each string tensioning head comprises an opening adapted to receive one of the end areas and being movable in a longitudinal direction by rotating one of the tensioning screw and the tuning mechanism. Rotation of each rotatable tuning mechanism causes each string tensioning head to move in the longitudinal direction without rotating.

The invention also provides for the combination of a string tensioning system and a string instrument having an instrument body, a plurality of strings, and a chamber accommodating end areas of the strings when the end areas are arranged between string introduction apertures and string exit apertures, wherein the combination comprises a plurality of string tensioning devices arranged on the stringed instrument. Each string tensioning device comprises a movable tuning mechanism, a tensioning screw, and a string tensioning head. Each tensioning screw extends into the chamber. Each string tensioning head is movably disposed in the chamber and is connected to one of the end areas. Each string tensioning head is movable by rotating one of the tensioning screw and the tuning mechanism. Rotation of each rotatable tuning mechanism causes each string tensioning head to move in a direction without rotating.

The invention also provides for a method of stringing a string instrument which includes the string tensioning system of any of the types described above, wherein the method comprises mounting the at least one tensionable string on the instrument body and subjecting the at least one tensionable string to tension by moving the string tensioning head.

The invention also provides for a method of stringing a string instrument which includes the string tensioning system of any of the types described above, wherein the method comprises mounting each of the plurality of strings on the instrument body and subjecting each of the plurality of strings to tension by moving the string tensioning heads.

The invention also provides for a method of stringing a string instrument which includes the string tensioning system of any of the types described above, wherein the method comprises mounting each of the plurality of strings on the instrument body and rotating at least one of the movable tuning mechanisms to subject at least one of the plurality of strings to tension.

The invention further provides for a method of stringing a string instrument which includes the string tensioning system of any of the types described above, wherein the method comprises mounting each of the plurality of strings on the instrument body and subjecting at least one of the plurality of strings to tension by moving the string tensioning heads.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
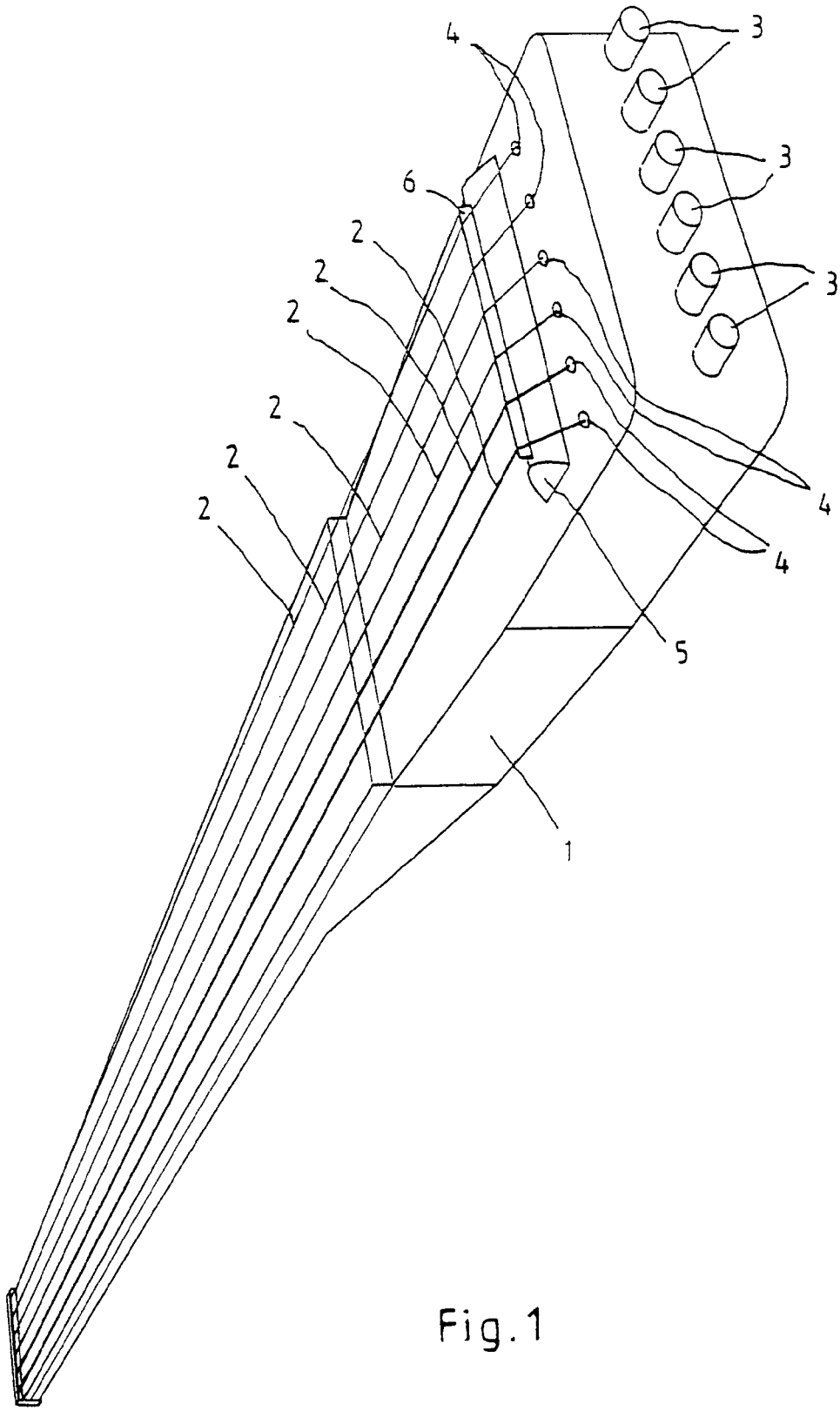
FIG. 1 shows a perspective view of a stringed instrument with instrument body and strings but without body support.

FIG. 1 shows a stringed instrument, which in this example is a guitar, having an instrument body 1 and six strings 2. The stringed instrument can, of course, be any type of string instrument. The body support required for playing the guitar is described in WO-A1-00/25296, the disclosure of which is expressly incorporated by reference in its entirety. The string tensioning device is accommodated in the instrument body 1, and in particular, in the end area of the guitar. Only the tuning screws 3 need be accessible from the outside. Each string 2 has one end that is fixed to the instrument body 1 at the end facing away from the tuning screws 3 and another end that is fixed in the string tensioning device. Each string 2 can also be introduced into the instrument body 1 to the string tensioning device through a feed aperture 4. In front of the feed apertures 4, the strings 2 lie on a bridge 5 with a bridge insert 6.

Figure 2:
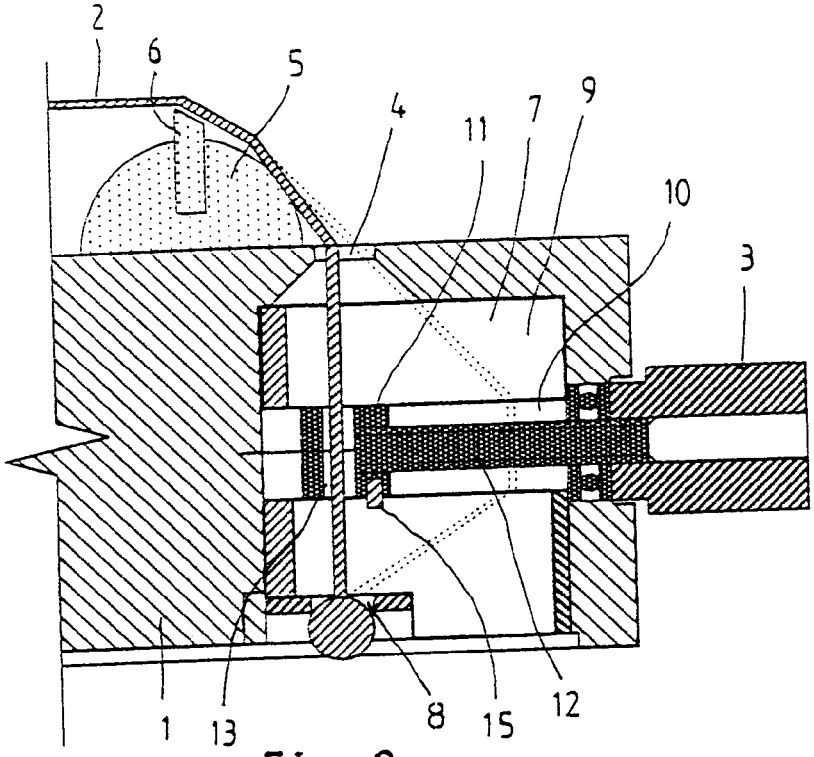
FIG. 2 shows a string tensioning device arranged in a filling body in sectional view.

FIG. 2 shows the end area of the instrument body 1 in sectional view. A tuning screw 3 is also shown in sectional view. As can be seen in the figure, the string 2 is introduced through a feed aperture 4 into a chamber 7 that is formed and/or is present in the instrument body 1. The string 2 is fixed to the instrument body 1 at a fixing point 8 on the side of the chamber 7 lying opposite to the feed aperture 4. A guiding body 9 (see also FIG. 3) is installed and/or arranged in the chamber 7. The guiding body 9 is provided with holes 10, which receive the tension heads 11, and slots 14, which receive the strings 2. The string tensioning heads 11 are movably and/or axially guided in these holes 10. Each string tensioning head 11 is fixed at or to the end of a tensioning screw 12. Each tension screw 12 has another end that engages with the internal screw thread of the tuning screws 3. The tuning screws 3 are supported and/or mounted on the instrument body 1 so that when the tuning screw 3 is rotated, the tensioning screw 12 is inserted into, i.e., threads or moves in and out of, the tuning screw 3. Movement of the tensioning heads 11 (by rotation of the screws 3 in one direction) towards the screws 3 causes a tensioning of the strings 2 and movement of the tensioning heads 11 (by rotation of the screws 3 in an opposite direction) away from the screws 3 causes a loosening of the strings 2. Each string 2 lying between the feed aperture 4 and the fixing point 8 is guided through a hole 13 in the string tensioning heads 11. In this way, when the tuning screw 3 is rotated, the string 2 is drawn into the hollow chamber 7 (i.e., towards screws 3) and is thus tensioned.

Figure 3:
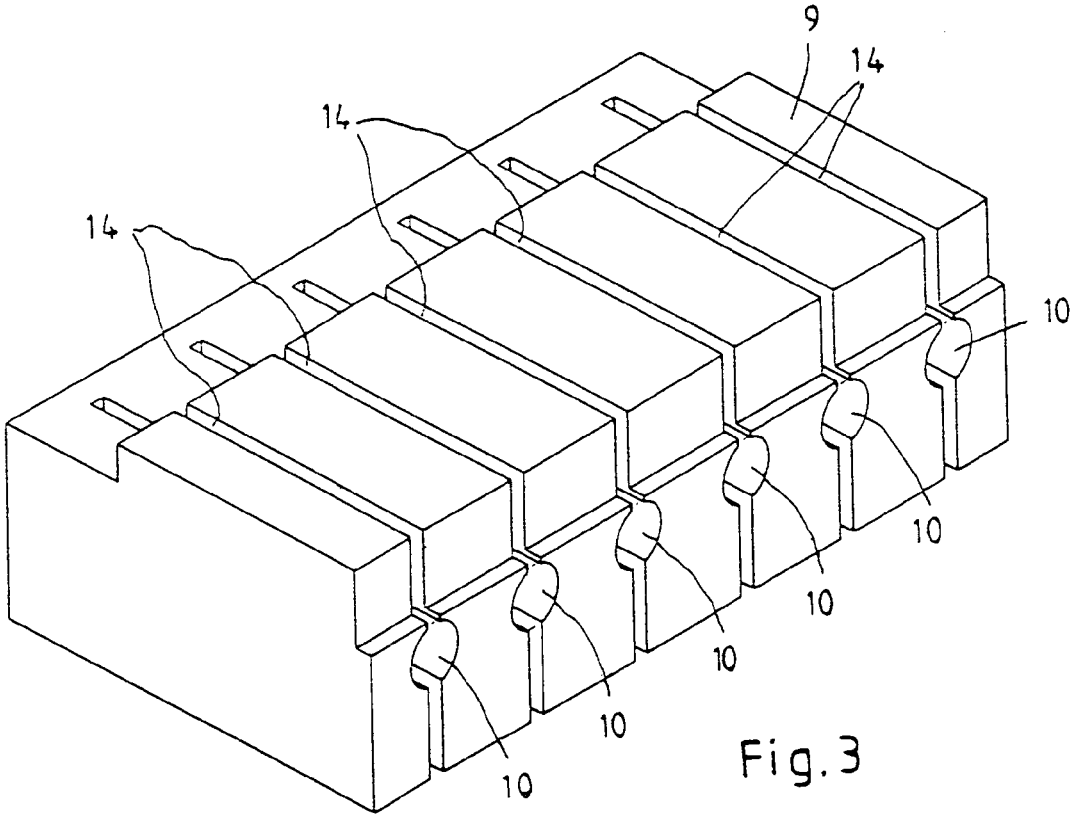
FIG. 3 shows a filling body of FIG. 2 as seen from below.

As is shown in FIG. 3, the guiding body 9 includes longitudinal slots 14. These slots 14 result in or define a free space on both sides of the string tensioning head 11. This free space permits a free lateral movement of the longitudinally displaceable strings 2, in the movement area of the string tensioning head 11, between the string tensioning head 11 and the feed aperture 4 as well as between the string tensioning head 11 and the fixing point 8. Each tensioning head 11 also includes a projecting pin 15. The pin 15 is guided in the slot 14 and serves to make the string tensioning head 11 torsion-proof, i.e., the pin 15 prevents the tensioning head from rotating when it moves axially in the opening 10. Using this arrangement, the string 2 can be tensioned without utilizing sharp-edged changes in direction. Thus, during tensioning of the string 2, excessive string wear and high tension forces can be avoided.

Figure 4:
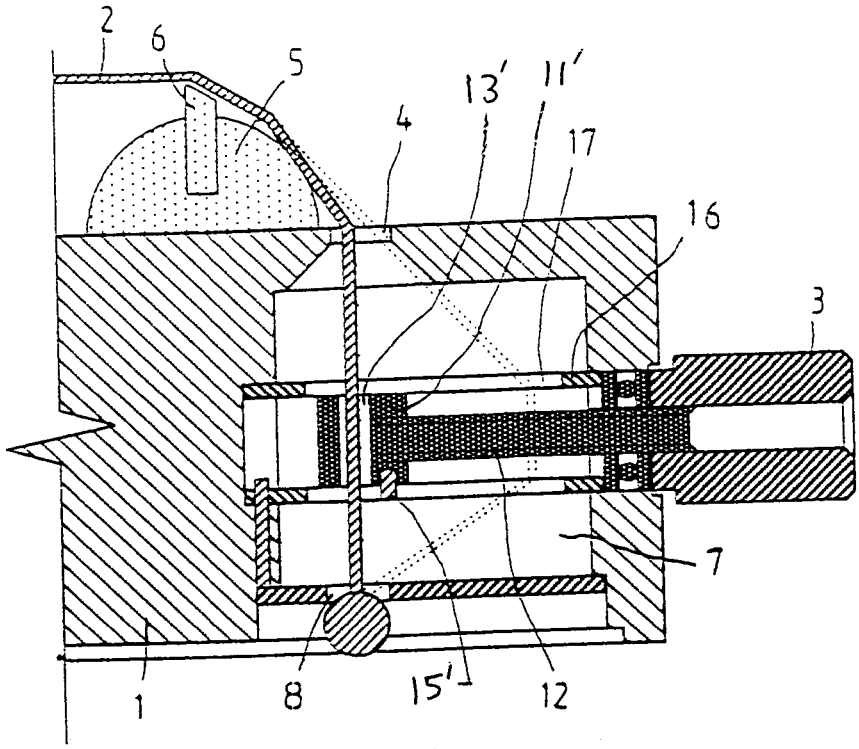
FIG. 4 shows a string tensioning device with a slotted sleeve in sectional view.
Figure 5:
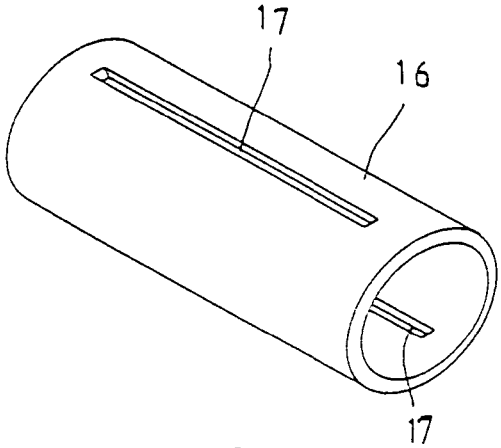
FIG. 5 shows the sleeve of FIG. 4.

FIG. 4 shows another embodiment of the string tensioning device in sectional view. In this arrangement, the string 2 is also guided through the feed aperture 4 and is also connected to the instrument body 1 at the fixing point 8. This embodiment utilizes slotted sleeves 16 (see also FIG. 5) which are arranged and/or mounted crosswise to the connecting line between the feed aperture 4 and the fixing point 8. The slotted sleeve 16 is used for axially movably guiding the string tensioning head 11' and is installed with both its end areas mounted in the instrument body 1. The sleeve 16 includes two slots 17 lying opposite to one another in the movement area of the string tensioning head 11'. The string 2 is guided through the slots 17 and is connected to the string tensioning head 11' via the hole 13'. As in the previous embodiment, the string tensioning head 11' can move laterally freely in the entire movement area on both sides of the string tensioning head 11'. A pin 15' is mounted and/or projects from the string tensioning head 11' and is guided in the slot 17 to ensure a torsion-proof guiding, i.e., to ensure that head 11' is axially movably and non-rotatably guided in sleeve 16. The reference numbers not described here in more detail describe similar features shown in FIG. 2.

Figure 6:
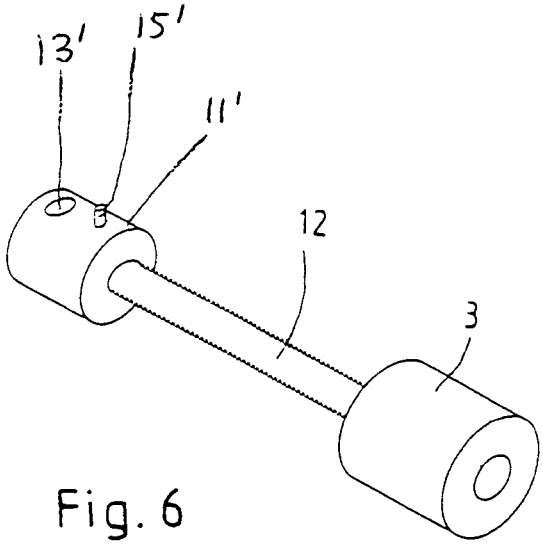
FIG. 6 shows a tensioning screw with string tensioning head of FIG. 4.
Figure 7:
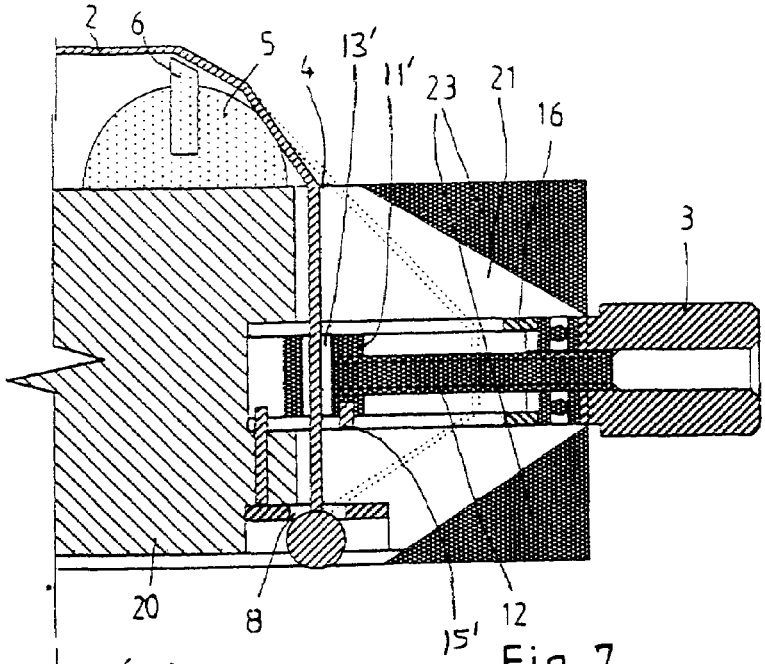
FIG. 7 shows a string tensioning device installed in the slotted end part of the instrument body, in sectional view.
Figure 8:
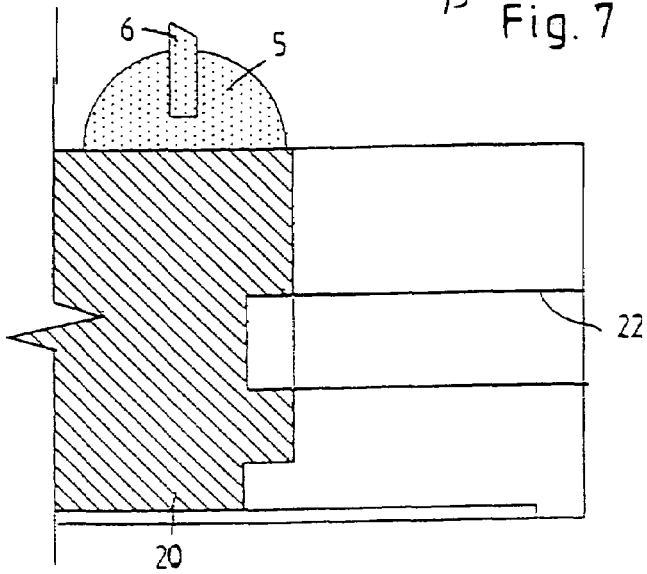
FIG. 8 shows the slotted end part of the instrument body before the installation of the tensioning device shown in FIG. 7.
Figure 9:
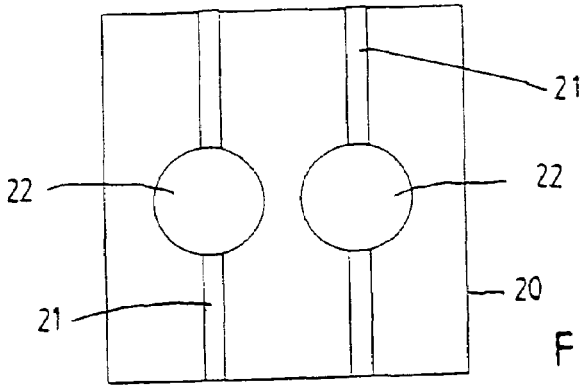
FIG. 9 shows the slotted end part seen from the end of the instrument body.

FIGS. 7, 8, and 9 show still another embodiment of the invention. In this embodiment, the instrument body 20 itself is utilized as part of the string tensioning device, arrangement or system. As can be seen in FIG. 8, slots 21 and holes 22 are utilized to accept sleeves 16. These slots 21 and holes 22 are installed in the end area of the instrument body 20. To ensure the stability of the instrument body 20 (i.e., to provide reinforcement to the body 20), pieces of material 23 are arranged in the corner areas of the slots 21 facing away from the instrument body 20. Thus, the corner areas are filled in with the pieces of material 23, which are fixed therein. A free space is arranged behind these pieces of material 23. The free space enables or allows for the free lateral movement of the string 2 connected to the string tensioning head 11' in the entire movement area. The sleeve 16 shown in FIG. 5 and the tensioning screw 12 shown in FIG. 6 are utilized in this embodiment, along with the string tensioning head 11' and with the tuning screw 3. The reference numbers not described in more detail are similar to those of the previous figures.

Figure 10:
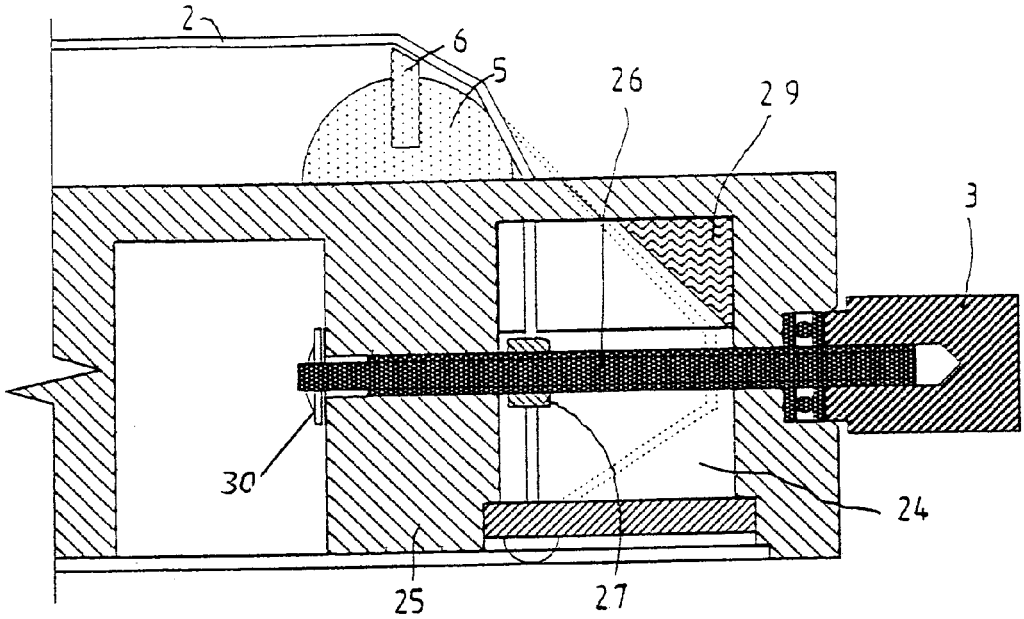
FIG. 10 shows a string tensioning device installed in a hollow chamber of the instrument body in sectional view with a string tensioning head mounted on a tensioning screw with a screw thread.
Figure 11:
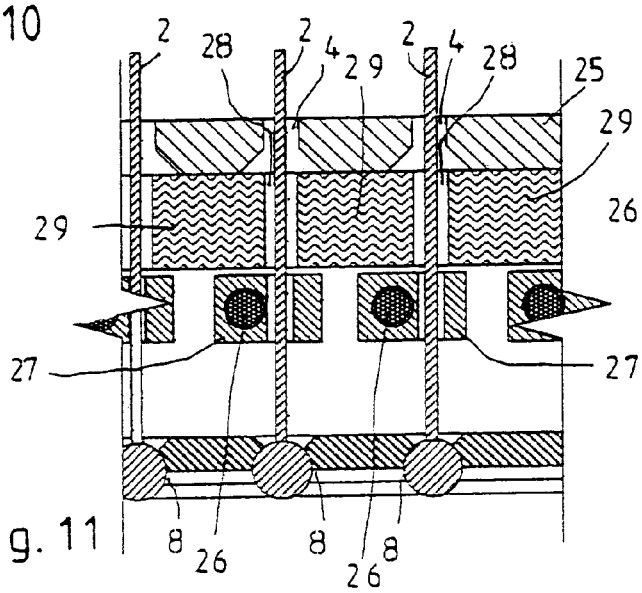
FIG. 11 shows the installed tensioning screw with the string and with the string tensioning head in sectional view.
Figure 12:
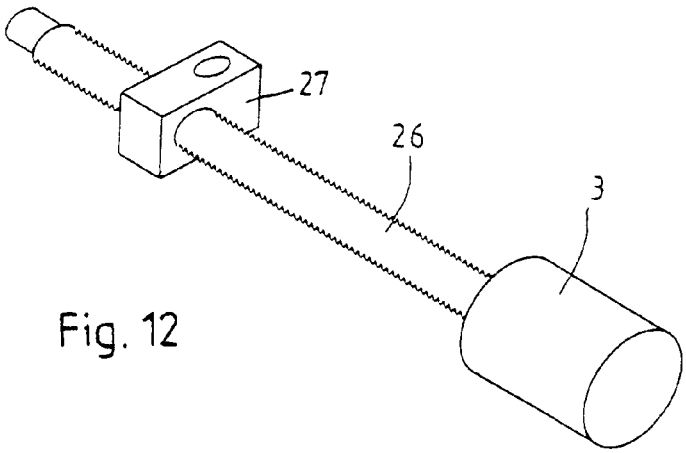
FIG. 12 shows the tensioning screw with the string tensioning head of FIGS. 10 and 11 in perspective view.

FIGS. 10, 11, and 12 describe still another embodiment of the invention. Here a string tensioning device is accommodated in a hollow chamber 24 in the instrument body 25. A tensioning screw 26 is mounted in the instrument body 25 in an axially nondisplaceable manner, i.e., it is prevented from moving in the longitudinal direction by, among other things, washer clips 30. These clips 30 constitute a mechanism for preventing the screws 26 from moving axially towards the screws 3, but allow the screws 26 to rotate. The tensioning screws 26 are arranged crosswise through this hollow chamber 24. The tensioning screw 26 can be rotated from the outside with the tuning screw 3. A string tensioning head 27 is provided with an internal screw thread which threadably engages external threads of the tensioning screw 26. This string tensioning head 27 comprises two parts. The first part is provided with an internal screw thread and the second part, which is embodied as a side wing that projects from the first part, is connected to the string 2. In order to ensure that the string tensioning head 27 is torsion-proof (i.e., prevented from rotating), an insert 29 is provided. The insert 29 includes slots 28 and is installed in the upper area of the hollow chamber 24. These slots 28 provide a free space that faces towards the feed aperture 4 and the fixing point 8. The free space is arranged on both sides of the connecting point of the string 2 at the string tensioning head 27. The free space allows the string 2 to exhibit a lateral free movement between the feed aperture 4 and the string tensioning head 27, as well as between the fixing point 8 and the string tensioning head 27.

The invention also contemplates an arrangement wherein the direction of rotation of the tensioning screw 26 can be reversed to tension the strings 2, i.e., instead of the strings moving towards the screws 3 during tensioning, the arrangement can also utilize a pushing movement of the string tensioning head 27 wherein the strings 2 are directed or moved away from the tuning screws 3. In this case, an appropriate chamber could be provided in the instrument body to accept the tensioning screw 26 and to accept movement of the string tensioning head 27 into this chamber. A simple arrangement could simply provide for bilateral free spaces in the instrument body 25. Such as arrangement could enable the use of a particularly short instrument body 25 ending with the feed aperture 4.

In each of the embodiments, bearings are provided to ensure that the tuning screws can rotate with as little effort as possible. These bearings can have any desired form and may simply have the form of a bushing, i.e., two washers whose engaging surfaces have a low friction surface. Moreover, by way of non-limiting examples, the materials for the various parts can be plastic, metal, wood, composite, etc. Thus, for example, the tuning screws 3, tensioning screws 12, 26, heads 11, 11' and 27, and sleeve 16 can be formed of metal or plastic. The block 9 can be formed of wood, metal or plastic.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A string tensioning system for a string instrument having an instrument body, at least one tensionable string that is fixed on at least one end at a fixing point, and a chamber accommodating a portion of the at least one tensionable string positioned between a string introduction aperture and the fixing point, the system comprising:

at least one string tensioning device adjustable from outside the instrument body, wherein the at least one string tensioning device is at least partially arranged in the chamber of the instrument body;

the at least one string tensioning device comprising a tensioning screw and a string tensioning head;

the tensioning screw extending into the chamber;

the string tensioning head being connectable to the portion and being movable by rotating the tensioning screw; and the chamber comprising free spaces on opposite sides of the string tension head that allow for free movement of the portion between the string tensioning head and the feed aperture and the portion between the string tensioning head and the fixing point, wherein the free spaces extend along a direction of movement of the string tensioning head and allow for the free movement of said portions of the string during movement of the string tensioning head within the chamber.

2. The system of claim 1, wherein the tensioning screw extends into the chamber crosswise to an axis running through the string introduction aperture and the fixing point.

3. The system of claim 1, further comprising a guiding body, wherein the string tensioning head is guided in the guiding body.

4. The system of claim 3, wherein the guiding body is a block-shaped guiding body.

5. The system of claim 1, further comprising at least one guiding sleeve, wherein the string tensioning head is guided within the at least one guiding sleeve.

6. The system of claim 5, wherein the at least one guiding sleeve comprises ends which are one of fixed to the instrument body and non-movably mounted to the instrument body.

7. The system of claim 1, further comprising at least one tuning screw coupled to the tensioning screw.

8. The system of claim 1, further comprising at least one tuning screw threadably engaging the tensioning screw, wherein rotation of the tuning screw causes the tensioning screw and the string tensioning head to move towards or away from the tuning screw.

9. The system of claim 1, further comprising at least one tuning screw connected to the tensioning screw, wherein rotation of the tuning screw causes the string tensioning head to move towards or away from the tuning screw.

10. The system of claim 9, wherein the tensioning screw is axially retained and rotatable.

11. The system of claim 1, further comprising a mechanism for preventing rotation of the string tensioning head.

12. The system of claim 11, wherein the mechanism is connected to the string tensioning head.

13. The system of claim 12, wherein the mechanism comprises one of a projection and a pin.

14. The system of claim 11, further comprising at least one guiding slot which receives the mechanism and which guides the string tensioning head in the longitudinal direction.

15. The system of claim 1, wherein the string tensioning head comprises an internal screw thread and an extended side portion that is connected to the portion.

16. The system of claim 15, wherein the extended side portion comprises an opening that receives the portion.

17. The system of claim 16, wherein the string tensioning head comprises a surface which engages another surface to prevent rotation of the string tensioning head during longitudinal movement of the string tensioning head.

18. The system of claim 1, wherein the instrument body is a guitar body.

19. A method of stringing a string instrument which includes the string tensioning system of claim 1, the method comprising:

mounting the at least one tensionable string on the instrument body; and subjecting the at least one tensionable string to tension by moving the string tensioning head.

20. A string tensioning system for a string instrument having an instrument body, at least one tensionable string that is fixed on at least one end at a fixing point, and a chamber accommodating a portion of the at least one tensionable string positioned between a string introduction aperture and the fixing point, the system comprising:

at least one string tensioning device adjustable from outside the instrument body, wherein the at least one string tensioning device is at least partially arranged in the chamber of the instrument body;

the at least one string tensioning device comprising a tensioning screw and a string tensioning head;

the tensioning screw extending into the chamber;

the string tensioning head being connectable to the portion and being movable by rotating the tensioning screw;

the chamber comprising free spaces on opposite sides of the string tension head that allow for free movement of the portion between the string tensioning head and the feed aperture and between the string tensioning head and the fixing point; and a guiding body, wherein the string tensioning head is guided in the guiding body, and wherein the guiding body comprises oppositely arranged slot-shaped recesses, wherein the slot-shaped recesses accommodate movement of the portion and allow for free lateral movement of the at least one tensionable string between the string tensioning head and the feed aperture and between the string tensioning head and the fixing point.

21. A string tensioning system for a string instrument having an instrument body, at least one tensionable string that is fixed on at least one end at a fixing point, and a chamber accommodating a portion of the at least one tensionable string positioned between a string introduction aperture and the fixing point, the system comprising:

at least one string tensioning device adjustable from outside the instrument body, wherein the at least one string tensioning device is at least partially arranged in the chamber of the instrument body;

the at least one string tensioning device comprising a tensioning screw and a string tensioning head;

the tensioning screw extending into the chamber;

the string tensioning head being connectable to the portion and being movable by rotating the tensioning screw;

the chamber comprising free spaces on opposite sides of the string tension head that allow for free movement of the portion between the string tensioning head and the feed aperture and between the string tensioning head and the fixing point; and at least one guiding sleeve, wherein the string tensioning head is guided within the at least one guiding sleeve, wherein the at least one guiding sleeve comprises oppositely arranged slots which accommodate the portion.

22. A string tensioning system for a string instrument having an instrument body, at least one tensionable string that is fixed on at least one end at a fixing point, and a chamber accommodating a portion of the at least one tensionable string positioned between a string introduction aperture and the fixing point, the system comprising;

at least one string tensioning device adjustable from outside the instrument body, wherein the at least one string tensioning device is at least partially arranged in the chamber of the instrument body;

the at least one string tensioning device comprising a tensioning screw and a string tensioning head;

the tensioning screw extending into the chamber;

the string tensioning head being connectable to the portion and being movable by rotating the tensioning screw;

the chamber comprising free spaces on opposite sides of the string tension head that allow for free movement of the portion between the string tensioning head and the feed aperture and between the string tensioning head and the fixing point; and at least one slot formed on an end of the instrument body, wherein the at least one slot communicates with the chamber.

23. The system of claim 22, further comprising pieces of material arranged in corner areas of the chamber.

24. The system of claim 23, wherein the pieces of material are inset and fixed, whereby free spaces are provided between adjacent pieces of material.

25. A string tensioning system for a string instrument having an instrument body, a plurality of strings, and a chamber accommodating end areas of the strings arranged between string introduction apertures and string exit apertures, the system comprising:

a plurality of string tensioning devices adapted to be mounted to the stringed instrument;

each string tensioning device comprising a rotatable tuning mechanism, a tensioning screw, and a string tensioning head;

each tensioning screw being adapted to extend into the chamber;

each string tensioning head comprising an opening adapted to receive one of the end areas;

each string tensioning head being movable by rotating one of the tensioning screw and the tuning mechanism; and guiding recesses arranged on opposite sides of each string tensioning head, the guiding recesses extending along a direction of movement of the string tensioning heads, wherein rotation of each rotatable tuning mechanism causes each string tensioning head to move without rotating, and wherein the guiding recesses guide movement of the end areas of the strings during rotation of each rotatable tuning mechanism.

26. A method of stringing a string instrument which includes the string tensioning system of claim 25, the method comprising:

mounting each of the plurality of strings on the instrument body; and subjecting each of the plurality of strings to tension by moving the string tensioning heads.

27. The combination of a string tensioning system and a string instrument having an instrument body, a plurality of strings, and a chamber accommodating end areas of the strings between string introduction apertures and string exit apertures, the combination comprising:

a plurality of string tensioning devices arranged on the stringed instrument;

each string tensioning device comprising a movable tuning mechanism, a tensioning screw, and a string tensioning head;

each tensioning screw extending into the chamber;

each string tensioning head being movably disposed in the chamber and being connected to one of the end areas, each string tensioning head being movable by rotating one of the tensioning screw and the tuning mechanism; and guiding slots located on opposite sides of each string tensioning head, the guiding slots extending along a direction of movement of the string tensioning heads, wherein rotation of each rotatable tuning mechanism causes each string tensioning head to move without rotating, and wherein the guiding slots guide movement of the end areas of the strings during rotation of each rotatable tuning mechanism.

28. A method of stringing a string instrument which includes the string tensioning system of claim 27, the method comprising:

mounting each of the plurality of strings on the instrument body; and rotating each movable tuning mechanism to subject each of the plurality of strings to tension.

29. A method of stringing a string instrument which includes the string tensioning system of claim 27, the method comprising:

mounting each of the plurality of strings on the instrument body; and subjecting each of the plurality of strings to tension by moving the string tensioning heads.

* * * * *